US007051798B2

(12) United States Patent
Moeller et al.

(10) Patent No.: US 7,051,798 B2
(45) Date of Patent: May 30, 2006

(54) HEAT EXCHANGER

(75) Inventors: Stefan Moeller, Munich (DE); Alfred Wanner, Deisenhofen (DE); Gabriele Engl, Munich (DE); Thomas Hecht, Gauting (DE); Wolfgang Suessmann, Munich (DE); Herbert Aigner, Engelsberg (DE)

(73) Assignee: Linde Aktiengesellschaft, Hollfiegelskreuth (DE)

( * ) Notice: Subject to any disclaimer, the term of this patent is extended or adjusted under 35 U.S.C. 154(b) by 96 days.

(21) Appl. No.: 10/785,409

(22) Filed: Feb. 25, 2004

(65) Prior Publication Data

US 2005/0006076 A1 Jan. 13, 2005

(30) Foreign Application Priority Data

Feb. 25, 2003 (DE) ..... 103 08 015
May 28, 2003 (EP) ..... 03012311

(51) Int. Cl.
*F28F 9/02* (2006.01)

(52) U.S. Cl. ..... 165/166; 165/174

(58) Field of Classification Search ..... 165/165, 165/166, 173–175, 140
See application file for complete search history.

(56) References Cited

U.S. PATENT DOCUMENTS

| | | | | |
|---|---|---|---|---|
| 3,792,842 | A | 2/1974 | Nakako et al. | |
| 5,144,809 | A | 9/1992 | Chevalier et al. | |
| 5,324,452 | A * | 6/1994 | Allam et al. | 165/166 |
| 5,333,683 | A | 8/1994 | Grelaud et al. | |
| 5,415,223 | A * | 5/1995 | Reavis et al. | 165/174 |
| 5,529,116 | A | 6/1996 | Sasaki et al. | |
| 5,690,166 | A * | 11/1997 | Yamaguchi | 165/174 |
| 6,089,313 | A | 7/2000 | Levy et al. | |
| 6,349,566 | B1 | 2/2002 | Howard et al. | |
| 6,437,662 | B1 | 8/2002 | Taniguch | |
| 2002/0011331 | A1 | 1/2002 | Werlen et al. | |
| 2002/0023739 | A1 | 2/2002 | Wagner et al. | |
| 2002/0066553 | A1 * | 6/2002 | Fischer et al. | 165/174 |
| 2002/0131919 | A1 | 9/2002 | Flynn et al. | |
| 2004/0108105 | A1 | 6/2004 | Dwyer | |
| 2004/0159121 | A1 * | 8/2004 | Horiuchi et al. | 165/153 |

FOREIGN PATENT DOCUMENTS

| | | |
|---|---|---|
| DE | 1910475 | 8/1970 |
| FR | 2812935 | 2/2002 |

OTHER PUBLICATIONS

Article 115 submission by L'Air Liquide's (Mar. 17, 2005) in corresponding EP Application No. 04001347.6-2301.

* cited by examiner

*Primary Examiner*—Teresa J. Walberg
(74) *Attorney, Agent, or Firm*—Miller, White, Zelano, Branigan, P.C.

(57) ABSTRACT

The invention relates to a plate heat exchanger with a heat exchanger block which has a multiplicity of heat exchange passages. The heat exchanger block has mounted on it a header which extends over at least part of one side of the heat exchanger block and makes a flow connection between part of the heat exchange passages. The header is provided with a fluid connection which is arranged essentially perpendicularly to that side of the heat exchanger block over which the header extends. (FIG. 6)

21 Claims, 2 Drawing Sheets

HEAT EXCHANGER

Figure 1:
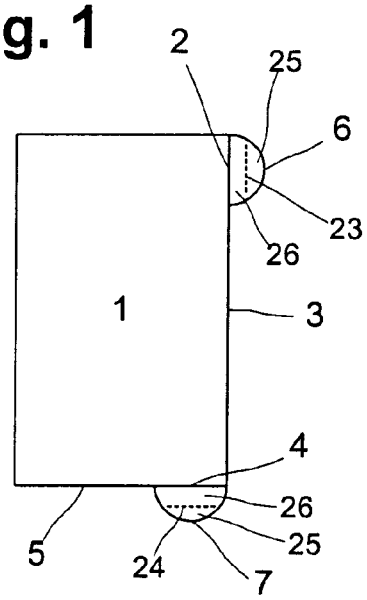

The invention relates to a plate heat exchanger with a heat exchanger block which has a multiplicity of heat exchange passages, the heat exchanger block having mounted upon it a header which extends over at least part of one side of the heat exchanger block and makes a flow connection between part of the heat exchange passages and which is provided with a fluid connection, the fluid connection being arranged essentially perpendicularly to that side of the heat exchanger block over which the header extends.

The heat exchanger block of a plate heat exchanger consists of a plurality of layers of heat exchange passages which are in each case delimited relative to one another by means of separating sheets. Closing strips and cover sheets form the outer frame of the heat exchanger block. Within a layer, further separating strips may be provided, which separate the heat exchange passages for different material streams from one another.

The heat exchanger block, initially consisting of loose components, is then soldered together in a soldering furnace, so that all the components are connected to one another in a leak-tight manner. Subsequently, headers, which are provided with a fluid connection, are welded on over the inlet and outlet orifices of the heat exchange passages. Semi-cylindrical shells are conventionally used as headers. The fluid connection is formed by tubular connection pieces which are arranged opposite the inlet and outlet orifices in the semi-cylindrical casing of the header. The pipelines for the fluid streams to be supplied and to be discharged are connected to these tubular connection pieces.

By virtue of a suitable arrangement of separating strips, plate heat exchangers can be used for the simultaneous heat exchange of a large number of fluid streams. For each of the fluid streams, corresponding headers must then be mounted over respective inlet and outlet orifices of the heat exchange passages and be provided with pipelines. The pipework of the plate heat exchanger is in this case highly complex and entails a high outlay.

The object of the present invention is to improve a plate heat exchanger of the type mentioned in the introduction.

The plate heat exchanger according to the invention has a heat exchanger block with a multiplicity of heat exchange passages. The heat exchange passages may be divided into specific groups, the heat exchange passages of a group serving in each case for routing a specific fluid stream. Headers are in each case mounted over the inlet and outlet orifices into the heat exchange passages of a group in such a way that a flow connection between these passages is made.

The header, sometimes also designated as a collector, covers part of one side of the heat exchanger block and forms with this side a closed-off space into which the inlet or outlet orifices of a group of heat exchange passages issue. According to the invention, the header is provided with a fluid connection which is arranged essentially perpendicularly to that side of the heat exchanger block over which the header extends.

The fluid connection, that is to say the orifice of the header to the pipelines supplying or discharging the respective fluid stream, is arranged in a plane which lies essentially perpendicularly to the plane in which the corresponding inlet or outlet orifices into the heat exchange passages are located. That is to say, the fluid connection is not located directly opposite the inlet or outlet orifices.

By virtue of the design according to the invention of the headers and particularly of the fluid connection, it becomes possible to provide all the fluid connections on two opposite sides of the heat exchanger block. It is often even possible to configure the plate heat exchanger in such a way that all the fluid connections are located on the same side of the heat exchanger block. The pipelines for supplying and discharging the material streams brought into heat exchange with one another therefore no longer have to be led around the heat exchanger block in a complicated way. The outlay in terms of pipework is appreciably reduced.

The header according to the invention not only serves for distributing the supplied fluid stream to the heat exchange passages or for collecting fluid emerging from the heat exchange passages, but also for supplying and discharging the corresponding fluid streams.

This double function is taken into account, according to the invention, by the provision, within the header, of means for routing the flow of the fluid supplied or discharged via the fluid connection. For example, the header may have arranged in it a guide sheet which subdivides the space within the header into a flow region, which preferably serves for supplying and discharging the fluid, and into a distribution region, in which the flow is calmed and as uniform a distribution as possible of the fluid to the heat exchange passages takes place.

Preferably, the headers possess a semicircular cross section, in particular semi-cylindrical shells have proved appropriate as headers. In such a header design in the form of a half-shell, the fluid connection is then located within one of the two semicircular base surfaces. For reasons of strength, it may be advantageous for the other of the base surfaces not to be oriented perpendicularly but, for example, obliquely to the semi-cylindrical casing.

In the versions used hitherto, the supply and discharge of the fluid streams take place via a tubular connection piece welded to the half-shell which must be provided at this point with a corresponding orifice, although the strength of the half-shell is markedly weakened thereby. In contrast to this, the fluid connection according to the invention is not located in the semi-cylindrical casing of the header, but in one of the semicircular base surfaces. With wall thicknesses remaining the same, the header according to the invention therefore has a higher strength than the known headers described above. Conversely, in the case of a predetermined desired strength, a smaller wall thickness can be selected in the design of the header according to the invention, with the result that the costs are lowered.

One of the main advantages of the invention, to be precise a simplification of the pipework, comes into effect especially when the plate heat exchanger has a plurality of heat exchanger blocks. For manufacturing reasons, for example because of the size of the soldering furnace, limits are placed on the dimensions of a heat exchanger block. If greater quantities of fluid are to be heated or cooled, it is necessary for two or more heat exchangers blocks to be arranged in parallel. Hitherto, as described in the introduction, in such a parallel arrangement, each heat exchanger block is provided with the corresponding headers and with the tubular connection pieces welded to them. For each material stream, a collecting line is provided, to which the corresponding tubular connection pieces are connected. The pipework of such plate heat exchangers consequently becomes extremely complicated.

By contrast, according to the invention, the heat exchanger blocks are not connected on the flow side via the tubular connection pieces and the collecting line, but, instead, the fluid connection of the header of a heat exchanger block is connected directly to the fluid connection of the header of an adjacent heat exchanger block. Preferably, the fluid connection extends over the entire cross section of the header and, with the cross section being maintained, is connected to the adjacent header. This results in a continuous header which extends over all the heat exchanger blocks.

Advantageously, in a plate heat exchanger with more than one heat exchanger block, the heat exchanger blocks are arranged, spaced apart, next to one another, so that a gap remains between the heat exchanger blocks. The heat exchanger blocks are connected to one another, as a rule welded to one another, preferably with a spacer being installed. The spacer used may be, for example, a correspondingly shaped sheet or a strip.

It is especially beneficial if the spacer is arranged in the region of the header in such a way that that side of the header which faces the heat exchanger blocks is completely covered by the spacer in the region of the gap. In this case, the space inside the header is delimited by the header itself, for example a semi-tubular shell, the side walls of the heat exchanger blocks and part of the spacer.

In the case of the parallel arrangement of a plurality of heat exchanger blocks, it becomes particularly clear that the header according to the invention not only serves for distributing the supplied fluid stream to the heat exchange passages or for collecting the fluid emerging from the heat exchange passages, but also for supplying and discharging the corresponding fluid streams.

Figure 2:
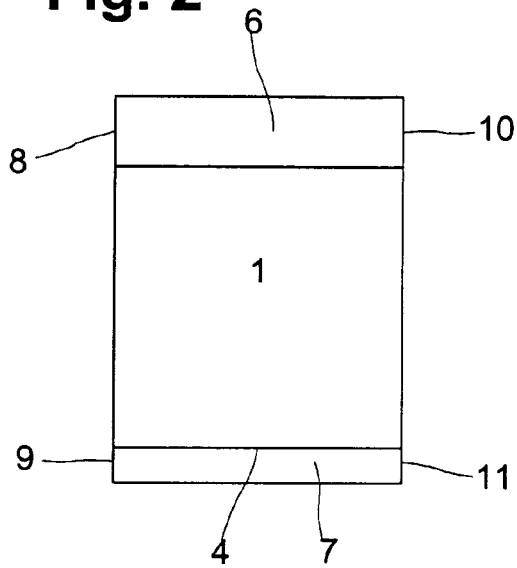
Figure 3:
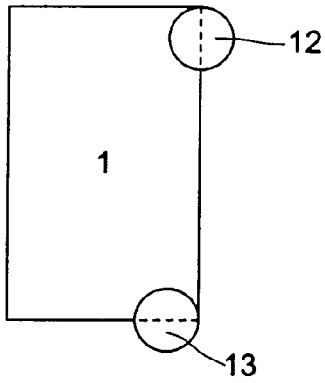
Figure 4:
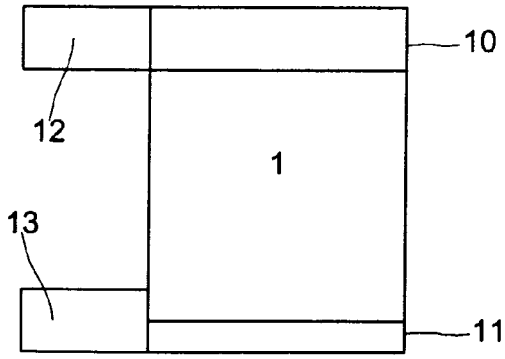
Figure 5:
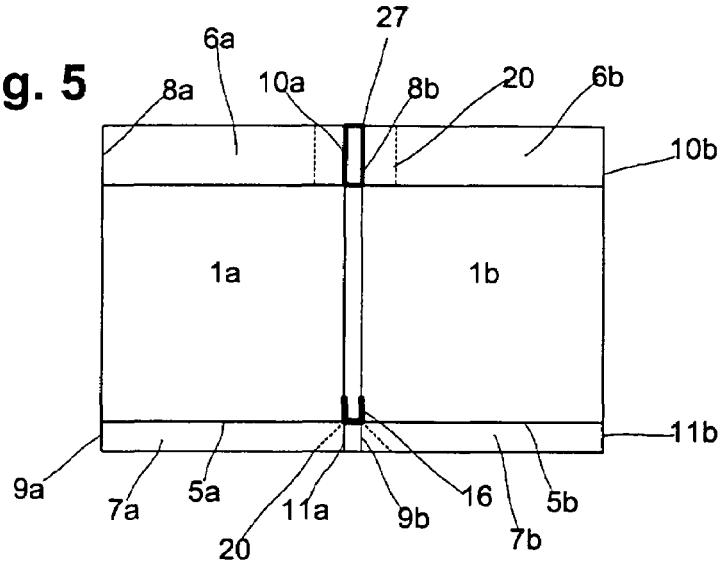
Figure 6:
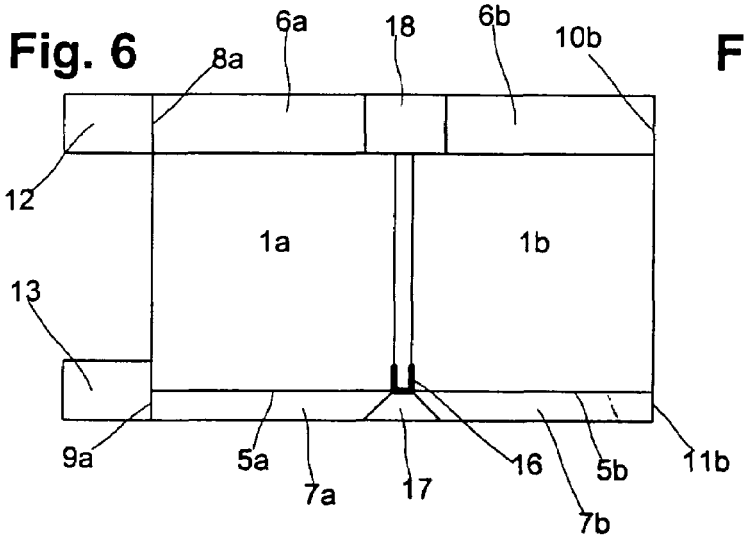
Figure 7:
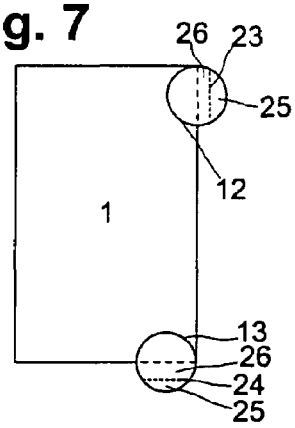

The invention and further particulars of the invention are explained in more detail below with reference to exemplary embodiments illustrated in the drawings in which:

FIGS. 1 and 2 show in each case a side view of a heat exchanger block with two headers, FIGS. 3 and 4 show the heat exchanger block with a pipeline piece welded on according to the invention, FIG. 5 shows two heat exchanger blocks arranged next to one another for producing a plate heat exchanger according to the invention, FIG. 6 shows a plate heat exchanger according to the invention, and FIG. 7 shows a side view of the plate heat exchanger according to FIG. 6.

FIGS. 1 and 2 illustrate diagrammatically a plate heat exchanger, such as is also known from the prior art. The plate heat exchanger has a heat exchanger block 1 with a multiplicity of heat exchange passages which are not shown in the figures for the sake of clarity. The inlet and outlet orifices of a group of heat exchange passages are located in the region 2 on a side wall 3 of the heat exchanger block 1 and in the region 4 on the underside 5 of the heat exchanger block 1, respectively. Semi-cylindrical headers 6, 7 are welded onto the regions 2, 3 having the inlet and outlet orifices.

The headers 6, 7 are designed as semi-cylindrical shells with base surfaces 8, 9, 10, 11. Arranged in the headers 6, 7 are guide sheets 23, 24 which subdivide the space within the headers 6, 7 into a flow region 25 and a distribution region 26. The guide sheets 23, 24 are provided with a multiplicity of orifices, so that gas and liquid exchange is possible between the flow region 25 and the distribution region 26.

The connection according to the invention of the pipework to the plate heat exchanger can be seen in FIGS. 3 and 4. The base surfaces 8, 9 of the semi-cylinders 6, 7, that is to say the side walls of the headers 6, 7, serve as fluid connections for the supply and discharge of the fluid conducted through the heat exchange passages. The other two base surfaces 10, 11 of the headers 6, 7 are closed. Pipelines 12, 13 are mounted on the base surfaces 8, 9. The pipelines 12, 13 are connected to the headers 6, 7 in a leak-tight manner, so that, for example, an inflowing fluid flows via the pipeline 12 through the open base surface 8 into the header 6 and is distributed in the header 6 to the corresponding heat exchange passages. In a similar way, after heat exchange, the fluid is discharged again via the header 7 and the pipeline 13.

The two pipelines 12, 13 are located on the same side of the heat exchanger block 1. The connection of the heat exchanger and the further pipework are thus easily possible.

FIG. 5 shows an intermediate stage in the production of a plate heat exchanger according to the invention. The heat exchanger blocks 1*a*, 1*b* are constructed identically to the heat exchanger block 1 illustrated in FIGS. 1 and 2.

The heat exchanger blocks 1*a*, 1*b* are first subjected, together with their respective headers 6*a*, 6*b*, 7*a*, 7*b*, to a leaktightness test and a compressive-strength test. After successful testing, all the base surfaces 8*a*, 9*a*, 10*a*, 11*a* of the headers 6*a* and 7*a* of the heat exchanger block 1*a* and the base surfaces 8*b*, 9*b* of the headers 6*b*, 7*b* of the heat exchanger block 1*b* are separated. Separation takes place on the two mutually confronting sides of the headers 6*a*, 6*b*, 7*a*, 7*b*, as illustrated in FIG. 5 by broken lines 20, obliquely to the axis of the semi-cylindrical headers 6*a*, 7*a*, 6*b*, 7*b*. The base surfaces 8*a*, 9*a* of the heat exchanger block 1*a* are cut off perpendicularly to the axis of the semi-cylindrical headers 6*a*, 7*a*.

The two heat exchanger blocks 1*a*, 1*b* are then welded together at their lower end by means of a sheet 16. The U-shaped sheet 16 is fastened to the heat exchanger blocks 1*a*, 1*b* in such a way that the base of the U-shaped sheet 16 connects the undersides 5*a*, 5*b* of the two blocks 1*a*, 1*b* in such a way that a continuous plane is obtained. In the region of the headers 6*a*, 6*b*, the two heat exchanger blocks 1*a*, 1*b* are likewise connected to a U-shaped sheet 27, the base of which is located in the drawing plane and extends from the upper edge 21*a*, 21*b* of the heat exchanger blocks 1*a*, 1*b* as far as the lower edge 22*a*, 22*b* of the headers 6*a*, 6*b*, at which edge the semi-cylindrical header casing meets the heat exchanger block 1*a*, 1*b*.

FIGS. 6 and 7 show the finished plate heat exchanger. An adapted intermediate piece 17, 18 in the form of a piece of cake is inserted in each case between the headers 6*a*, 6*b* and the headers 7*a*, 7*b* of the two heat exchanger blocks 1*a*, 1*b* and is welded to the headers 6*a*, 6*b*, 7*a*, 7*b* and to the U-shaped sheets 16. Pipelines 12, 13 are welded to the base surfaces 8*a*, 9*a* of the headers 6*a*, 7*a*. The two pipelines 12, 13 are located on the same side of the heat exchanger block 1*a*. The connection and further pipework of the heat exchanger are thus easily possible.

During operation, for example, the fluid is supplied via the pipeline 12 and flows into the flow region 25, separated by the guide sheet 23, of the header 6*a* and, via the connection piece 18 in the form of a piece of cake, into the flow region 25 of the header 6*b*. The guide sheets 23 of the two headers 6*a*, 6*b* have a multiplicity of orifices, through which the fluid passes into the flow-calmed distribution regions 26. In the distribution regions 26 of the headers 6*a*, 6*b*, the fluid is distributed to the corresponding heat exchange passages of the heat exchanger blocks 1*a*, 1*b*.

Similarly, after heat exchange, the fluid is discharged again via the headers 7*a*, 7*b*, together with the intermediate connection piece 17, and via the pipeline 13. The headers 7*a*, 7*b* are likewise subdivided by a guide sheet 24 into a flow-calmed region 26 and a flow region 25. The flow-calmed region 26 in this case serves essentially for collecting and combining the fluid emerging from the heat exchange passages and the flow region 25 serves for discharging the fluid to the pipeline 13.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding German application No. 10308015.5, filed Feb. 25, 2003, and European application No. 03012311.1, filed May 28, 2003, are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A plate heat exchanger comprising:

a heat exchanger block having a multiplicity of heat exchange passages having inlet and outlet orifices, said heat exchanger block having mounted upon it a header which extends over at least part of one side of the heat exchanger block, said header having a fluid connection for supplying or removing fluid from part of said heat exchange passages, said fluid connection being arranged in a plane which lies essentially perpendicularly to the plane in which corresponding inlet or outlet orifices of said heat exchange passages are located, and means (23, 24), within said header (6, 7), for routing the flow of fluid supplied or discharged via said fluid connection (12, 13).

2. A plate heat exchanger according to claim 1, wherein said header (6, 7) possesses a semicircular cross section.

3. A plate heat exchanger according to claim 1, wherein said plate heat exchanger has a plurality of heat exchanger blocks (1*a*, 1*b*), and a header (6*a*, 6*b*; 7*a*, 7*b*) in which flow connection between heat exchange passages of various heat exchanger blocks (1*a*, 1*b*) is made.

4. A plate heat exchanger according to claim 3, wherein said heat exchanger blocks (1*a*, 1*b*) are arranged, spaced apart, next to one another, and the gap between the heat exchanger blocks (1*a*, 1*b*) is closed by means of a sheet (16, 27) or a strip in such a way that that side of the header (6*a*, 6*b*; 7*a*, 7*b*) which faces the heat exchanger blocks (1*a*, 1*b*) is completely covered by the side faces (5*a*, 5*b*; 6*a*, 6*b*) of the heat exchanger block (1*a*, 1*b*) and/or the sheet or strip (16, 27).

5. A plate heat exchanger according to claim 2, wherein said plate heat exchanger has a plurality of heat exchanger blocks (1*a*, 1*b*), and a header (6*a*, 6*b*; 7*a*, 7*b*) in which flow connection between heat exchange passages of various heat exchanger blocks (1*a*, 1*b*) is made.

6. A plate heat exchanger according to claim 5, wherein said heat exchanger blocks (1*a*, 1*b*) are arranged, spaced apart, next to one another, and the gap between the heat exchanger blocks (1*a*, 1*b*) is closed by means of a sheet (16, 27) or a strip in such a way that that side of the header (6*a*, 6*b*; 7*a*, 7*b*) which faces the heat exchanger blocks (1*a*, 1*b*) is completely covered by the side faces (5*a*, 5*b*; 6*a*, 6*b*) of the heat exchanger block (1*a*, 1*b*) and/or the sheet or strip (16, 27).

7. A plate heat exchanger according to claim 1, wherein said means for routing the flow of fluid supplied or discharged are guide sheets (23, 24) which subdivide the space within said header into a flow region (25) and a distribution region (26), and said guide sheets are provided with a multiplicity of orifices to permit gas and liquid exchange between said flow region (25) and said distribution region (26).

8. A plate heat exchanger according to claim 1, wherein said header has a semicircular cross section and is in the shape of a semi-cylindrical shell, and said fluid connection is located in one of two semicircular base surfaces of said header.

9. A plate heat exchanger according to claim 8, wherein the other of said two semicircular base surfaces of said header is oriented obliquely to the semi-cylindrical shell.

10. A plate heat exchanger according to claim 1, wherein said plate heat exchanger has a plurality of heat exchanger blocks (1*a*, 1*b*) wherein each of said heat exchanger blocks has a multiplicity of heat exchange passages having inlet and outlet orifices, and said header (6*a*, 5*b*; 7*a*, 7*b*) provides fluid communication between said flow connection and said multiplicity of heat exchange passages in each of said plurality of heat exchanger blocks (1*a*, 1*b*).

11. A plate heat exchanger according to claim 1, wherein said plate heat exchanger has a plurality of heat exchanger blocks (1*a*, 1*b*) wherein each of said heat exchanger blocks has a multiplicity of heat exchange passages having inlet and outlet orifices, and a header, wherein the header of one heat exchanger block is connected directly to said fluid connection of the header of an adjacent heat exchanger block resulting in a continuous header which extends over all the heat exchanger blocks.

12. A plate heat exchanger according to claim 1, wherein said plate heat exchanger has at least two headers, a first header which extends over one side of the heat exchanger block, and a second header which extends over another side of the heat exchanger block, said first header having a first fluid connection for supplying fluid to part of said heat exchange passages and said second header having a second fluid connection for removing fluid from part of said heat exchange passages, each of said fluid connections being arranged in a plane which lies essentially perpendicularly to the plane in which corresponding inlet or outlet orifices of said heat exchange passages are located.

13. A plate heat exchanger according to claim 12, wherein each of said first and second headers has a semicircular cross section and is in the shape of a semi-cylindrical shell, said first fluid connection is located in one of two semicircular base surfaces of said first header, and said second fluid connection is located in one of two semicircular base surfaces of said second header.

14. A plate heat exchanger according to claim 12, wherein said first fluid connection and said second fluid connection are both being located on the same side of said heat exchanger block.

15. A plate heat exchanger according to claim 1, wherein said plate heat exchanger has a plurality of heat exchanger blocks (1*a*, 1*b*), each of said heat exchanger blocks having a multiplicity of heat exchange passages having inlet and outlet orifices, each of said heat exchange blocks having a supply header which is in fluid communication with inlet orifices of part of said heat exchange passages, each of said heat exchange blocks having a discharge header which is in fluid communication with outlet orifices of part of said heat exchange passages, each of said supply header having a first fluid connection which is arranged in a plane which lies essentially perpendicularly to the plane in which corresponding inlet orifices of said heat exchange passages are located, each of said discharge header having a second fluid connection which is arranged in a plane which lies essentially perpendicularly to the plane in which corresponding outlet orifices of said heat exchange passages are located, wherein the supply header of one heat exchanger block is connected directly to the fluid connection of the supply header of an adjacent heat exchanger block resulting in a continuous supply header extending over all the heat exchanger blocks, and wherein the discharge header of one heat exchanger block is connected directly to the fluid connection of the discharge header of an adjacent heat exchanger block resulting in a continuous discharge header extending over all the heat exchanger blocks.

16. A plate heat exchanger according to claim 15, wherein said continuous supply header has a semicircular cross section and is in the shape of a semi-cylindrical shell, said continuous discharge header has a semicircular cross section and is in the shape of a semi-cylindrical shell, a fluid connection of said continuous supply header is located in one of two semicircular base surfaces of said continuous supply header, and a fluid connection of said continuous discharge header is located in one of two semicircular base surfaces of said continuous discharge header.

17. A plate heat exchanger according to claim 16, wherein the fluid connections of said continuous supply header and said continuous discharge header that are located in the semicircular base surfaces are both being located on the same side of said heat exchanger block.

18. A plate heat exchanger according to claim 3, wherein said heat exchanger blocks (1*a*, 1*b*) are arranged, spaced apart, next to one another, and are welded together by means of a U-shaped sheet (16) whereby the U-shaped sheet (16) connects the undersides (5*a*, 5*b*) of said heat exchanger blocks (1*a*, 1*b*) in such a way that a continuous plane is obtained.

19. A plate heat exchanger according to claim 5, wherein said heat exchanger blocks (1*a*, 1*b*) are arranged, spaced apart, next to one another, and are welded together by means of a U-shaped sheet (16) whereby the U-shaped sheet (16) connects the undersides (5*a*, 5*b*) of said heat exchanger blocks (1*a*, 1*b*) in such a way that a continuous plane is obtained.

20. A plate heat exchanger comprising:

a heat exchanger block having a multiplicity of heat exchange passages having inlet and outlet orifices, a supply header mounted on said heat exchange block which extends over at least part of one side of the heat exchanger block and which is in fluid communication with inlet orifices of part of said heat exchange passages, and a discharge header mounted on said heat exchange block and which is in fluid communication with outlet orifices of part of said heat exchange passages, said supply header having a first fluid connection which is arranged in a plane which lies essentially perpendicularly to the plane in which corresponding inlet orifices of said heat exchange passages are located, said discharge header having a second fluid connection which is arranged in a plane which lies essentially perpendicularly to the plane in which corresponding outlet orifices of said heat exchange passages are located, a first routing means, within said supply header, for routing the flow of fluid supplied via said first fluid connection, a second routing means, within said discharge header, for routing the flow of fluid to be discharged via said second fluid connection (12, 13).

21. A plate heat exchanger comprising:

a heat exchanger block having a multiplicity of heat exchange passages having inlet and outlet orifices, said heat exchanger block having mounted upon it a header which extends over at least part of one side of the heat exchanger block, said header having a fluid connection for supplying or removing fluid from part of said heat exchange passages, said fluid connection being arranged being arranged so as to not be located directly opposite inlet or outlet orifices of said heat exchange passages, and means (23, 24), within said header (6, 7), for routing the flow of fluid supplied or discharged via said fluid connection (12, 13).

* * * * *

UNITED STATES PATENT AND TRADEMARK OFFICE

CERTIFICATE OF CORRECTION

PATENT NO. : 7,051,798 B2
APPLICATION NO. : 10/785409
DATED : May 30, 2006
INVENTOR(S) : Stefan Moeller It is certified that error appears in the above-identified patent and that said Letters Patent is hereby corrected as shown below:

Column 6, line 24 reads "(6*a*, 5*b*; 7*a*, 7*b*)" should read -- (6*a*, 6b; 7*a*, 7*b*) --
Column 8, line 43 reads "arranged being arranged so as" should read -- arranged so as --

Signed and Sealed this

Thirtieth Day of January, 2007

JON W. DUDAS
*Director of the United States Patent and Trademark Office*